US009623297B2

(12) United States Patent
Chick et al.

(10) Patent No.: US 9,623,297 B2
(45) Date of Patent: Apr. 18, 2017

(54) GOLF CLUB HEAD

(71) Applicant: SRI SPORTS LIMITED, Kobe-shi (JP)

(72) Inventors: Andrew P. Chick, Solon, OH (US); Christopher R. Cooper, Orange, CA (US); Sharon J. Park, Irvine, CA (US); Kevin R. Tassistro, Huntington Beach, CA (US)

(73) Assignee: SRI SPORTS LIMITED, Kobe-shi (JP)

( * ) Notice: Subject to any disclaimer, the term of this patent is extended or adjusted under 35 U.S.C. 154(b) by 245 days.

(21) Appl. No.: 14/498,781

(22) Filed: Oct. 7, 2014

(65) Prior Publication Data

US 2015/0024872 A1 Jan. 22, 2015

Related U.S. Application Data

(63) Continuation of application No. 13/852,555, filed on Mar. 28, 2013, now Pat. No. 8,870,677, which is a (Continued)

(51) Int. Cl.

| | |
|---|---|
| ***A63B 53/04*** | (2015.01) |
| *A63B 53/06* | (2015.01) |
| *A63B 60/54* | (2015.01) |

(52) U.S. Cl.

CPC ..... *A63B 53/047* (2013.01); *A63B 53/04* (2013.01); *A63B 53/06* (2013.01); *A63B 60/54* (2015.10);

(Continued)

(58) Field of Classification Search

USPC ..... 473/324–350

See application file for complete search history.

(56) References Cited

U.S. PATENT DOCUMENTS

| | | | |
|---|---|---|---|
| 2,774,600 | A | 12/1956 | Reach |
| 2,846,228 | A | 8/1958 | Reach |

(Continued)

FOREIGN PATENT DOCUMENTS

| | | | |
|---|---|---|---|
| JP | 08257171 | A | 10/1996 |
| JP | 09117537 | A | 5/1997 |

(Continued)

OTHER PUBLICATIONS

Dec. 28, 2012 Notice of Allowance issued in U.S. Appl. No. 12/219,826.

(Continued)

*Primary Examiner* — Alvin Hunter

(74) *Attorney, Agent, or Firm* — Oliff PLC

(57) ABSTRACT

A golf club may include a front surface, a rear surface having a recess, and an insert at least partially disposed in the recess. The insert may comprise a durometer hardness of less than about 95 Shore A and a cavity having a reinforcement member disposed therein. Preferably, the durometer hardness of the reinforcement member is also less than about 95 Shore A. The insert may further comprise an anterior perimetric boundary having a first length and a posterior perimetric boundary having a second length. The ratio of the first length to the second length may be less than 1 and greater than 0.5. In one example, the insert may have a triangular front profile and a triangular side profile.

19 Claims, 10 Drawing Sheets

Related U.S. Application Data continuation of application No. 12/219,826, filed on Jul. 29, 2008, now Pat. No. 8,430,766.

(52) U.S. Cl.
CPC ... *A63B 2053/0491* (2013.01); *A63B 2209/02* (2013.01)

(56) References Cited

U.S. PATENT DOCUMENTS

| | | | |
|---|---|---|---|
| 4,928,972 | A | 5/1990 | Nakanishi et al. |
| 4,964,640 | A | 10/1990 | Nakanishi et al. |
| 5,014,993 | A | 5/1991 | Antonious |
| D319,858 | S | 9/1991 | Antonious |
| 5,242,167 | A | 9/1993 | Antonious |
| 5,290,036 | A | 3/1994 | Fenton et al. |
| 5,348,302 | A | 9/1994 | Sasamoto et al. |
| 5,429,353 | A | 7/1995 | Hoeflich |
| 5,540,436 | A | 7/1996 | Boone |
| 5,658,208 | A | 8/1997 | Shimasaki |
| 5,795,245 | A | 8/1998 | Chang et al. |
| 6,042,486 | A | 3/2000 | Gallagher |
| 6,085,761 | A | 7/2000 | Inaba |
| 6,179,726 | B1 | 1/2001 | Satoh |
| 6,186,903 | B1 | 2/2001 | Beebe et al. |
| 6,206,790 | B1 | 3/2001 | Kubica et al. |
| 6,592,468 | B2 | 7/2003 | Vincent et al. |
| 6,592,469 | B2 | 7/2003 | Gilbert |
| 6,616,547 | B2 | 9/2003 | Vincent et al. |
| D481,775 | S | 11/2003 | Best |
| 6,688,989 | B2 | 2/2004 | Best |
| 6,695,714 | B1 | 2/2004 | Bliss et al. |
| 6,719,641 | B2 | 4/2004 | Dabbs et al. |
| D492,376 | S | 6/2004 | Nicolette et al. |
| 6,743,114 | B2 | 6/2004 | Best |
| 6,811,496 | B2 | 11/2004 | Wahl et al. |
| 6,835,144 | B2 | 12/2004 | Best |
| 6,849,005 | B2 | 2/2005 | Rife |
| 6,855,066 | B2 | 2/2005 | Best |
| 6,855,069 | B2 | 2/2005 | Nagai et al. |
| D502,975 | S | 3/2005 | Schweigert et al. |
| D503,204 | S | 3/2005 | Nicolette et al. |
| D504,167 | S | 4/2005 | Iwata et al. |
| 6,902,495 | B2 | 6/2005 | Pergande et al. |
| D509,554 | S | 9/2005 | Best et al. |
| D511,360 | S | 11/2005 | Kawami |
| 6,962,538 | B2 | 11/2005 | Roach et al. |
| D513,423 | S | 1/2006 | Best et al. |
| D514,183 | S | 1/2006 | Schweigert et al. |
| D515,159 | S | 2/2006 | Best et al. |
| D517,146 | S | 3/2006 | Nishitani |
| D523,501 | S | 6/2006 | Nicolette et al. |
| D528,178 | S | 9/2006 | Best |
| 7,125,343 | B2 | 10/2006 | Imamoto |
| D532,850 | S | 11/2006 | Oldknow |
| 7,137,903 | B2 | 11/2006 | Best et al. |
| 7,147,571 | B2 | 12/2006 | Best et al. |
| 7,207,900 | B2 | 4/2007 | Nicolette et al. |
| 7,232,377 | B2 | 6/2007 | Gilbert et al. |
| 7,238,119 | B2 | 7/2007 | Roach et al. |
| 7,244,188 | B2 | 7/2007 | Best |
| 7,338,387 | B2 | 3/2008 | Nycum et al. |
| 7,390,270 | B2 | 6/2008 | Roberts et al. |
| 7,399,238 | B2 | 7/2008 | Hocknell et al. |
| 7,473,190 | B2 | 1/2009 | Hocknell et al. |
| 7,559,850 | B2 | 7/2009 | Gilbert et al. |
| 7,563,176 | B2 | 7/2009 | Roberts et al. |
| 7,588,503 | B2 | 9/2009 | Roach et al. |
| 8,079,919 | B2 | 12/2011 | Roach et al. |
| 8,870,677 | B2 * | 10/2014 | Chick ..... A63B 53/047 473/332 |
| 2002/0098910 | A1 | 7/2002 | Gilbert |
| 2003/0139225 | A1 | 7/2003 | Rife |
| 2005/0197208 | A1 | 9/2005 | Imamoto |
| 2005/0202899 | A1 | 9/2005 | Roach et al. |
| 2005/0239572 | A1 | 10/2005 | Roach et al. |
| 2005/0266931 | A1 | 12/2005 | Hou et al. |
| 2005/0266932 | A1 | 12/2005 | Roach et al. |
| 2006/0030425 | A1 | 2/2006 | Sukman |
| 2006/0128497 | A1 | 6/2006 | Hou et al. |
| 2006/0166758 | A1 | 7/2006 | Roberts et al. |
| 2006/0223652 | A1 | 10/2006 | Hou |
| 2007/0042834 | A1 | 2/2007 | Nicolette et al. |
| 2007/0042836 | A1 | 2/2007 | Best et al. |
| 2008/0058119 | A1 | 3/2008 | Soracco et al. |
| 2008/0242444 | A1 | 10/2008 | Park et al. |

FOREIGN PATENT DOCUMENTS

| | | | |
|---|---|---|---|
| JP | 09285576 | A | 11/1997 |
| JP | 09322952 | A | 12/1997 |
| JP | 10179815 | A | 7/1998 |
| JP | 11299940 | A | 11/1999 |
| JP | A-2000-084126 | | 11/1999 |
| JP | A-2000-084126 | | 3/2000 |
| JP | A-2001-161868 | | 6/2001 |
| JP | A-2005-279093 | | 10/2005 |

OTHER PUBLICATIONS

Oct. 5, 2012 Office Action issued in U.S. Appl. No. 12/219,826.
May 19, 2012 Office Action issued in U.S. Appl. No. 12/219,826.
Dec. 1, 2009 Office Action issued in U.S. Appl. No. 12/219,826.
Sep. 12, 2013 Office Action issued in U.S. Appl. No. 13/852,555.
Mar. 14, 2014 Office Action issued in U.S. Appl. No. 13/852,555.
Jun. 27, 2014 Notice of Allowance issued in U.S. Appl. No. 13/852,555.

* cited by examiner

GOLF CLUB HEAD

This is a Continuation of application Ser. No. 13/852,555, filed Mar. 28, 2013, which is a Continuation of application Ser. No. 12/219,826, filed Jul. 29, 2008 (now U.S. Pat. No. 8,430,766 B2 issued Apr. 30, 2013). The disclosure of the prior applications is hereby incorporated by reference herein in its entirety.

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

Conventional iron-type golf club heads often utilize a perimeter-weighting element to improve the mass properties of the head. Perimeter-weighted irons are typically more "forgiving" than those of the blade type because the elevated moment of inertia generally associated with perimeter-weighted designs reduces undesirable head rotation when a ball is mishit, or struck away from the point of orthogonal projection of the club head's center of gravity onto the striking surface of the head. Diminished rotation of the club head at ball impact beneficially affects the accuracy and distance of mishit shots.

Other known improvements associated with iron-type clubs include, e.g., replacing portions of the metallic material of the club head with lower-density non-metallic inserts. The resulting discretionary-weight surplus may be strategically distributed throughout the club head to increase its moment of inertia. However, conventional inserts are commonly made from substantially inelastic materials to comply with USGA rules that require all parts of the golf club to be rigid. Such inserts generally lack the compliance necessary to augment forgiveness of the club head on off-center shots. Moreover, typical inserts composed of more compliant material generally have a monolithic construction antonymous with superlative head-weight distribution.

SUMMARY

The present invention, in one or more aspects thereof, may comprise a golf club head having enhanced forgiveness on off-center shots, improved tactile feedback, and reduced hook/slice tendencies.

In one example, a golf club head, according to one or more aspects of the present invention, may include a front surface, a rear surface comprising a recess, and an insert at least partially disposed in the recess. The insert may have a durometer hardness less than about 95 Shore A and may include a cavity having a reinforcement member therein. The reinforcement member may also have a durometer hardness less than about 95 Shore A.

In another example, a golf club head, according to one or more aspects of the present invention, may include a front surface, a rear surface comprising a recess, and an insert at least partially disposed in the recess. The insert may include a generally triangular anterior profile and a generally triangular side profile.

In another example, a golf club head, according to one or more aspects of the present invention, may include a front surface, a rear surface comprising a recess, and an insert at least partially disposed in the recess. The insert may include an anterior side comprising a first substantially planar perimetric boundary having a first length and a posterior side comprising a second substantially planar perimetric boundary having a second length. Preferably, the ratio of the first length to the second length is less than 1 and greater than 0.5.

In another example, a golf club head, according to one or more aspects of the present invention, may include a front surface and a rear surface comprising an upper portion, a lower muscle portion, a plurality of imaginary reference paths, and an insert having a durometer hardness less than about 95 Shore A. The lower muscle portion may include at least one articulation points along at least one of the plurality of imaginary reference paths.

These and other features, aspects, and advantages of the golf club head according to the invention in its various aspects, as demonstrated by one or more of the various examples, will become apparent after consideration of the ensuing description, the accompanying drawings, and the appended claims. The drawings described below are for illustrative purposes only and are not intended to limit the scope of the present invention.

BRIEF DESCRIPTION OF THE DRAWINGS

Exemplary implementations of the invention will now be described with reference to the accompanying drawings, wherein.

DETAILED DESCRIPTION

Examples of the golf club head according to one or more aspects of the invention will be described using one or more definitions, provided below.

Figure 1A:
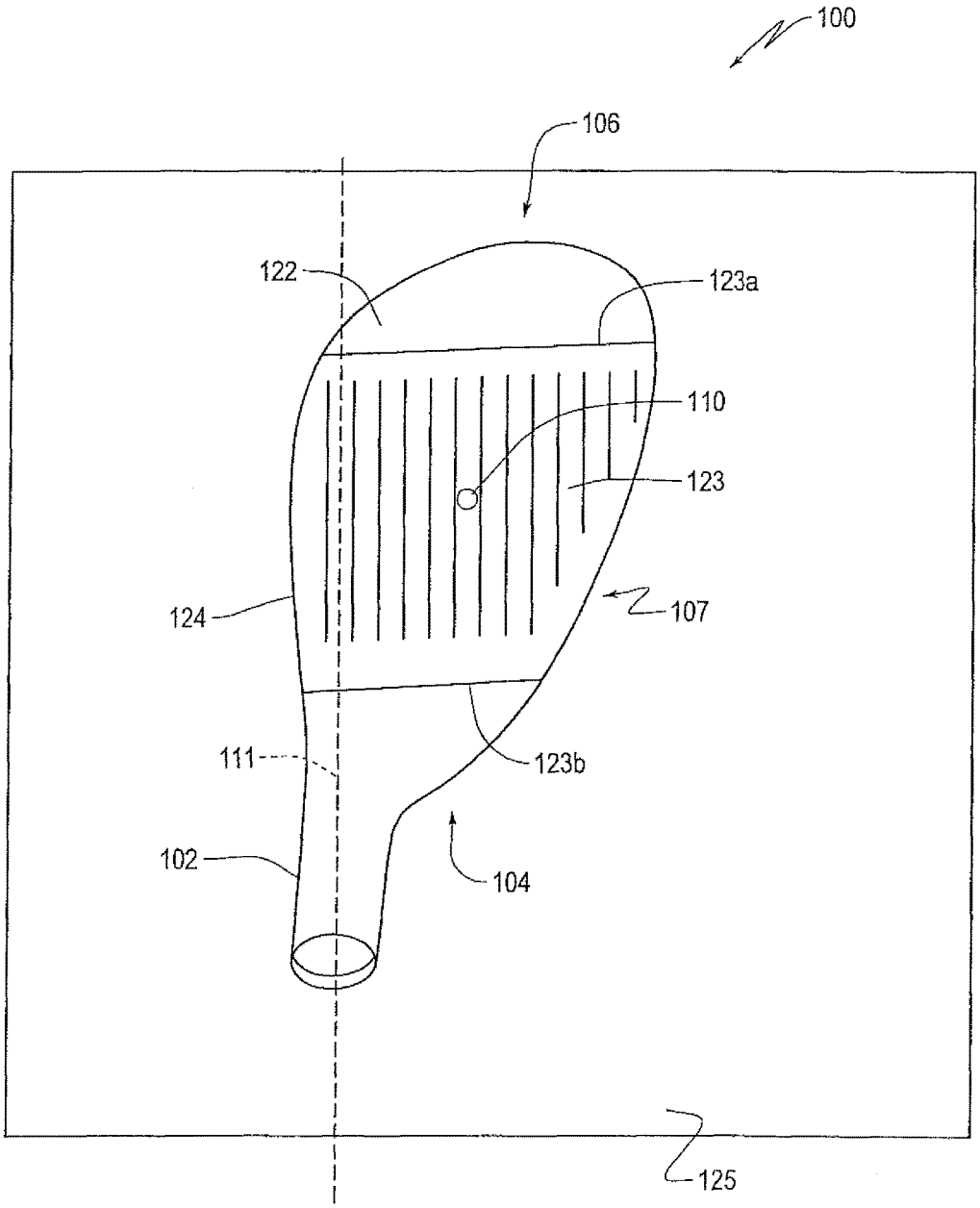
FIG. 1A is a top plan view of an exemplary golf club head in accordance with one or more aspects of the present invention.
Figure 1B:
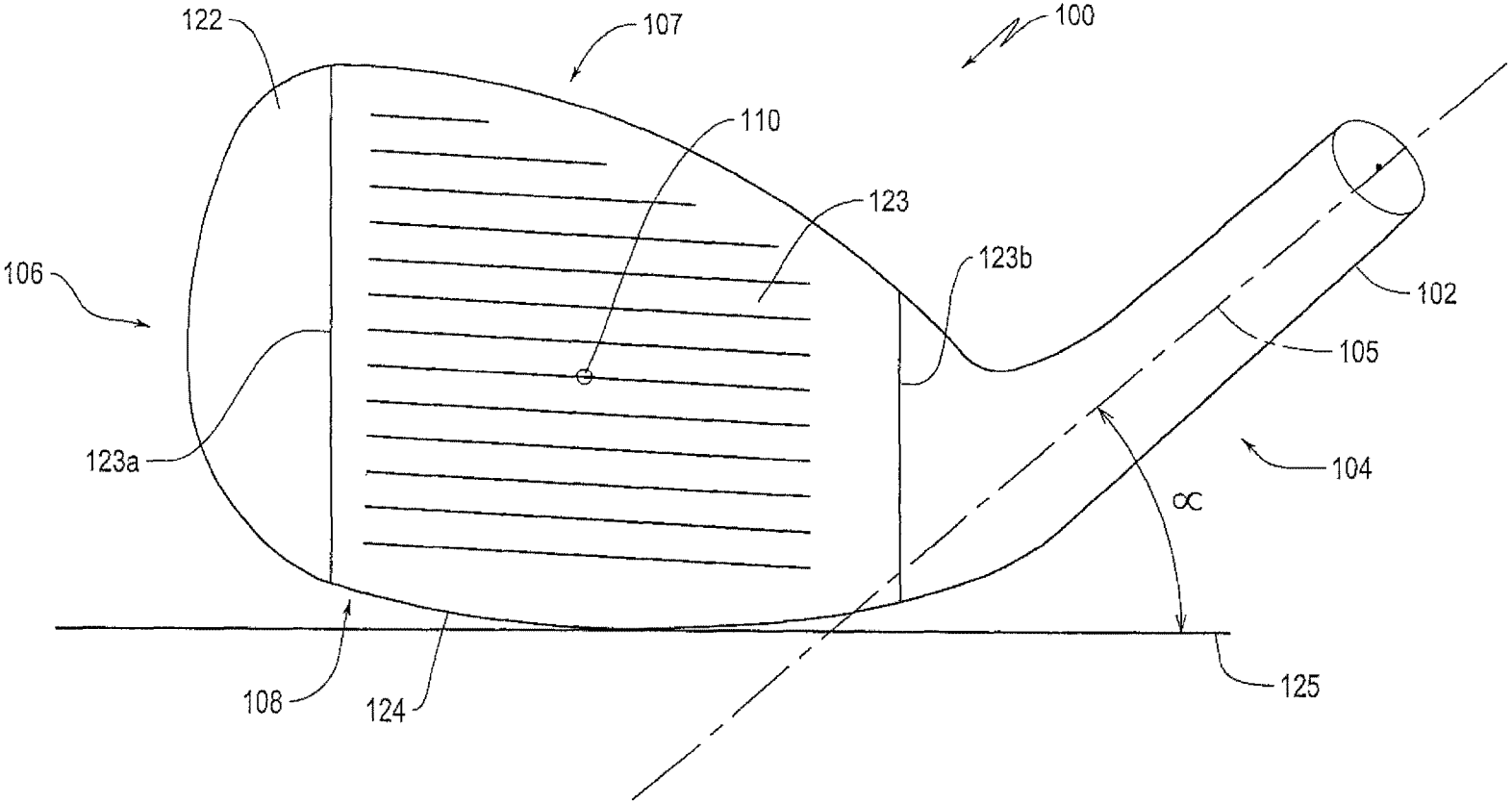
FIG. 1B is a front elevational view of the golf club head of FIG. 1A.

Referring to FIGS. 1A and 1B, a club head 100, shown in the "reference position," may comprise a toe portion 106, a heel portion 104, a hosel 102 having a central axis (centerline) 105, a top line portion 107, a sole portion 108, and a front surface 122. The front surface 122 includes a face center 110, a leading edge 124, and a striking face 123, delimited by boundaries 123*a* and 123*b*.

Referring again to FIGS. 1A and 1B, "reference position," as used herein, denotes the position of the club head 100 where the hosel centerline 105 is in an imaginary vertical plane 111 and is oriented at the club head's actual lie angle $\alpha$ with respect to a horizontal ground plane 125. The imaginary vertical plane 111 is generally parallel to the leading edge 124 of the front surface 122.

Figure 1C:
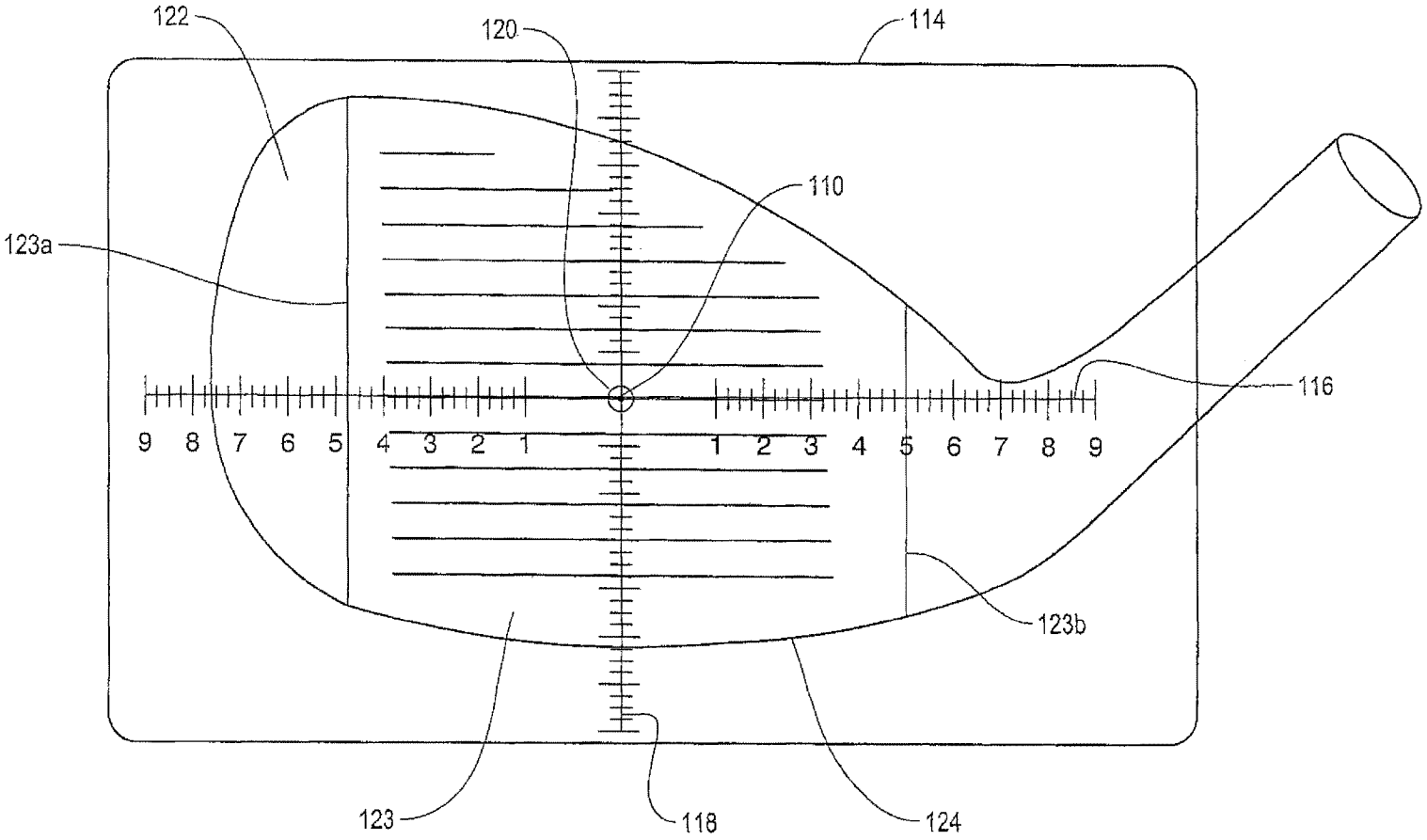
FIG. 1C is a front elevational view of the golf club head of FIG. 1A with a template applied thereto.

Referring again to FIGS. 1B and 1C, "face center", e.g., the face center 110, as used herein, may be located using a template 114, having a coordinate system with a graduated heel-toe axis 116 that is orthogonal to a graduated sole-top line axis 118. An aperture 120 lies at the origin of the coordinate system. The template 114 may be made of a flexible material, e.g., a transparent sheet polymer. The template is used as follows to locate the face center 110:

1) The template 114 is placed on the front surface 122, with the heel-toe axis 116 substantially parallel to the leading edge 124. The template is then laterally centered relative to the striking face 123 (in the heel-toe direction), whereby the measurements along the heel-toe axis 116 at the opposite boundaries of the striking face 123, are of equal magnitude, but opposite sign.
2) While maintaining the heel-toe orientation of step 1, above, vis-à-vis the face 123, the template 114 is centered relative to the striking face 123 in the sole-top line direction, whereby the measurements along the sole-top line axis 118 at the opposite edges of the face 123 are of equal magnitude, but opposite sign.
3) Steps 1 and 2, above, are repeated until the template 114 is centered relative to the striking face 123 both in the heel-toe and the sole-top line direction. A point corresponding to the location of the aperture 120 on the striking face 123 indicates the face center 110.

Figure 2A:
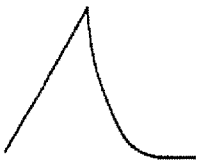
FIGS. 2A-2F illustrate a plurality non-arcuate junctions in accordance with one or more aspects of the present invention.
Figure 2B:
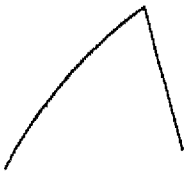
Figure 2C:
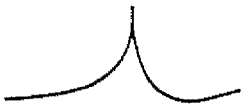
Figure 2D:
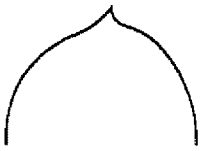
Figure 2E:
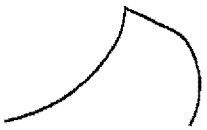
Figure 2F:
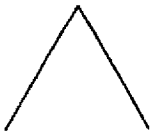

"Non-arcuate junction," as used herein, refers to a junction of two lines where an arcuate line intersects a straight line (FIGS. 2A and 2B), an arcuate line intersects another arcuate line (FIGS. 2C, 2D, and 2E), or a straight line intersects another straight line (FIG. 2F).

Figure 3A:
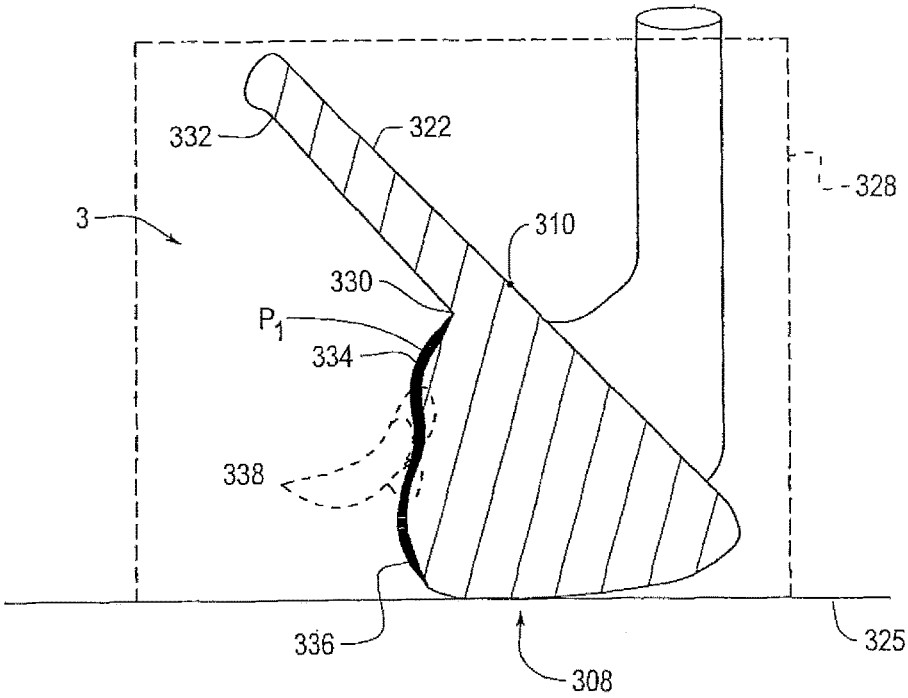
FIG. 3A is a toe-side cross-sectional view of an exemplary golf club head in accordance with one or more aspects of the present invention.
Figure 3B:
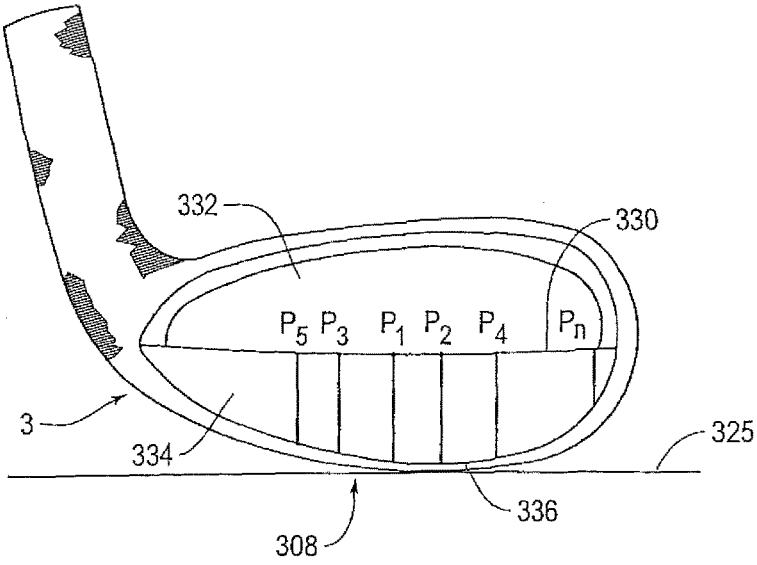
FIG. 3B is a rear elevational view of the golf club head of FIG. 3A.

Referring to FIGS. 3A and 3B, "articulation point", e.g., one of articulation points 338, as used herein, denotes a location along one or more of a plurality of imaginary reference paths $P_1, \ldots P_n$ where the path curvature changes from concave to convex or vice versa. As shown in FIG. 3A, reference path $P_1$ is characterized by the intersection of an imaginary vertical plane 328 and a muscle portion 334 of an exemplary club head 300. The imaginary vertical plane 328 is oriented substantially perpendicular to a front surface 322 and passes through a face center 310, with the club head in the reference position. The reference path $P_1$ is bounded by a rear sole edge 336 and a transition boundary 330 between an upper portion 332 and the lower muscle portion 334 of the club head.

As shown in FIG. 3B, other reference paths, e.g., paths $P_2$, $P_3$, $P_4$, and $P_5$, may be laterally spaced from the reference path $P_1$, e.g., in increments of one centimeter. Such reference paths are characterized by intersections of imaginary vertical planes (not shown), parallel to the imaginary vertical plane 328, with the muscle portion 334 of the club head. Paths $P_2$, $P_3$, $P_4$, and $P_5$ are bounded by the sole edge 336 and the transition boundary 330.

Figure 4A:
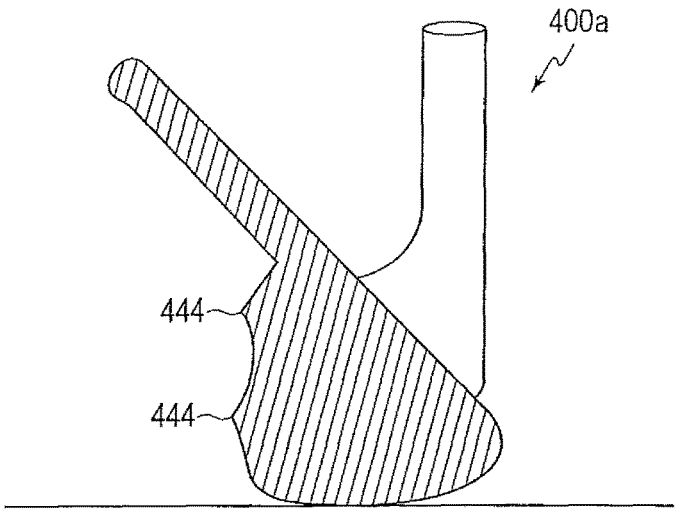
FIG. 4A is a toe-side cross-sectional view of an exemplary golf club head in accordance with one or more aspects of the present invention.
Figure 4B:
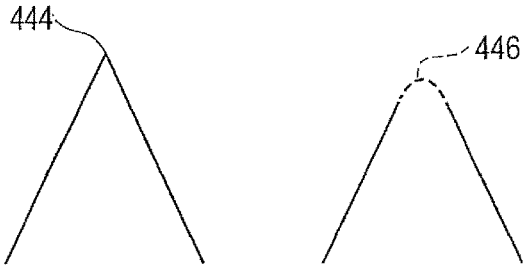
FIG. 4B illustrates substitution of exemplary non-arcuate junctions with radiused junctions.
Figure 4C:
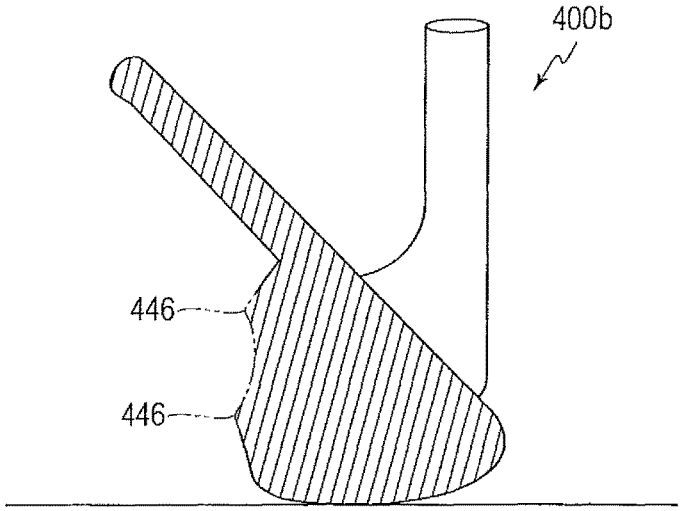
FIG. 4C is a toe-side cross-sectional view of an exemplary golf club head in accordance with one or more aspects of the present invention.

When determining whether one of the plurality of reference paths $P_1 \ldots P_n$ changes curvature, it is assumed that all non-arcuate junctions along each reference path are arcuate. For example, each non-arcuate junction 444 (FIG. 4A) of the club head 400*a* is substituted with an imaginary arcuate junction 446 (FIGS. 4B and 4C), having an infinitesimally small radius.

"Discretionary weight", as used herein, denotes the difference between the target mass of the club head and the minimum structural mass required to form the club head.

Figure 5A:
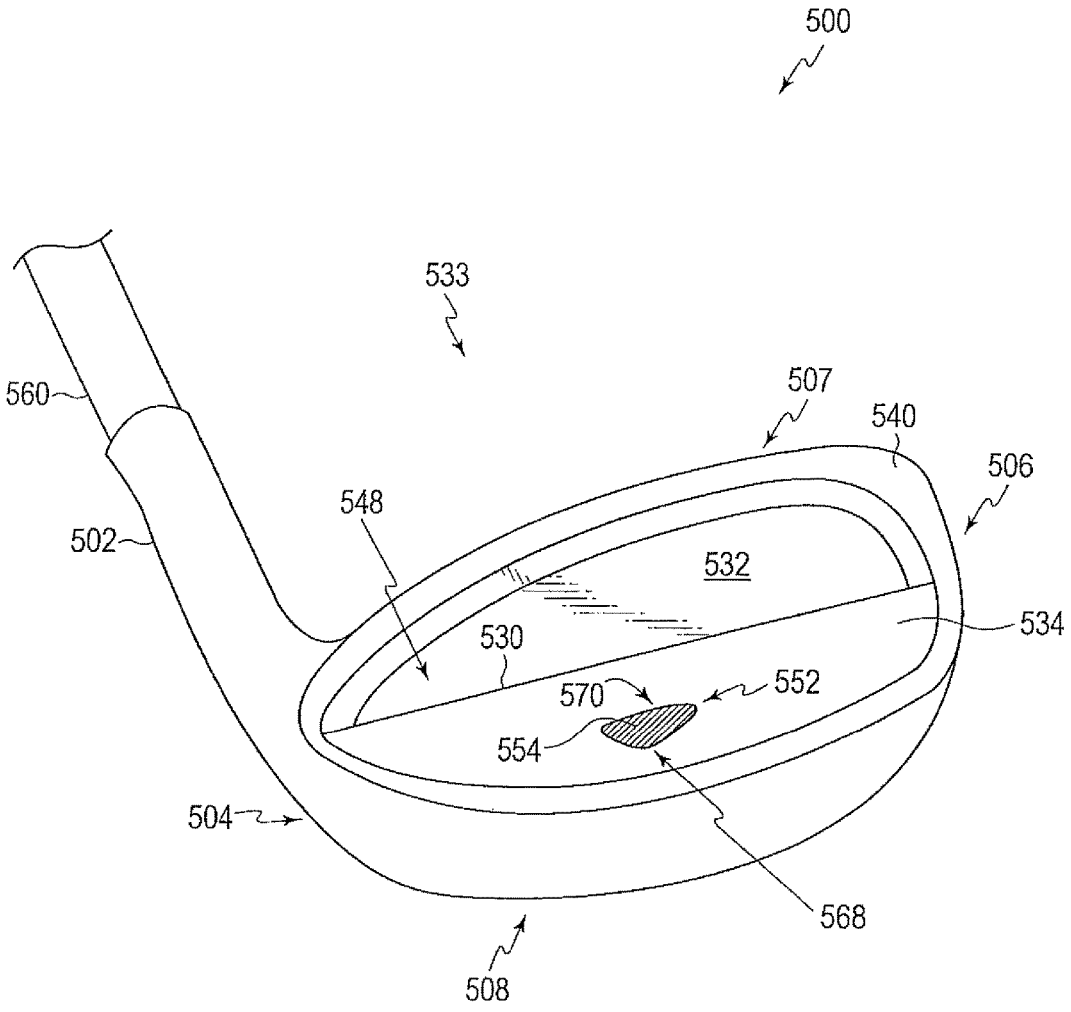
FIG. 5A is a rear perspective view of an exemplary golf club head in accordance with one or more aspects of the present invention.
Figure 5B:
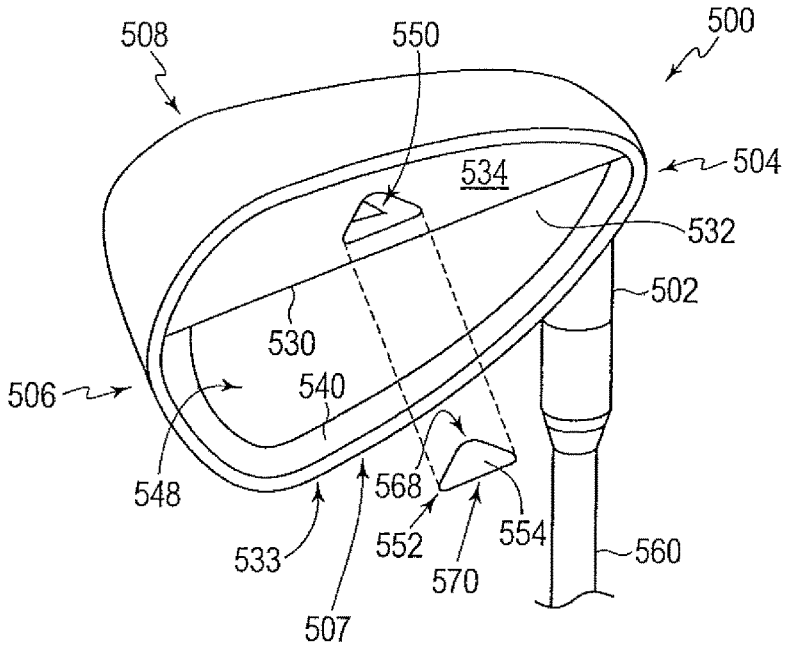
FIG. 5B is an exploded view of the golf club head of FIG. 5A.

Turning now to FIGS. 5A and 5B, a golf club head 500, according to one or more aspects of the present invention, may comprise a substantially planar front surface (not shown), characterized by a top-line portion 507, a sole portion 508, a toe portion 506, and a heel portion 504. A rear surface 533, located behind the front surface, may include an upper portion 532 and a muscle portion 534. Typically, the upper portion 532 and the muscle portion 534 are separated by a transition boundary 530. The upper portion 532 may include a main recess 548 and a perimeter weighting element 540 to improve the mass properties of the club head 500. An auxiliary recess 550 may be entirely disposed within the muscle portion 534. Preferably, the volume of the auxiliary recess 550 may be between about 0.5 $cm^3$ and about 5 $cm^3$. More preferably, the volume may be between about 1 $cm^3$ and about 3 $cm^3$.

Referring again to FIGS. 5A and 5B, an insert 552, according to one or more aspects of the present invention, may be disposed at least partially within the auxiliary recess 550. The insert 552 may be made from an elastic material having a Shore hardness less than about 95 A, preferably less than about 85 A, and more preferably less than about 70 A, to provide a soft tactile sensation. The tactilely perceptible softness of the insert may communicate to the golfer an improvement in the dynamic-excitation response characteristics of the golf club head at ball impact, thus promoting increased player confidence in the equipment. More specifically, the insert 552 is provided, at least in part, for abatement of unfavorable vibrations, associated, e.g., with mishit shots. Examples of the resilient materials suitable for fabricating the insert 552 may include polyurethane, silicone, Nylon, polypropylene (PP), polyethylene (PE), thermoplastic rubber (TPR), thermoplastic vulcanizate (TPV), thermoplastic elastomers (TPE), and natural rubber.

Figure 5C:
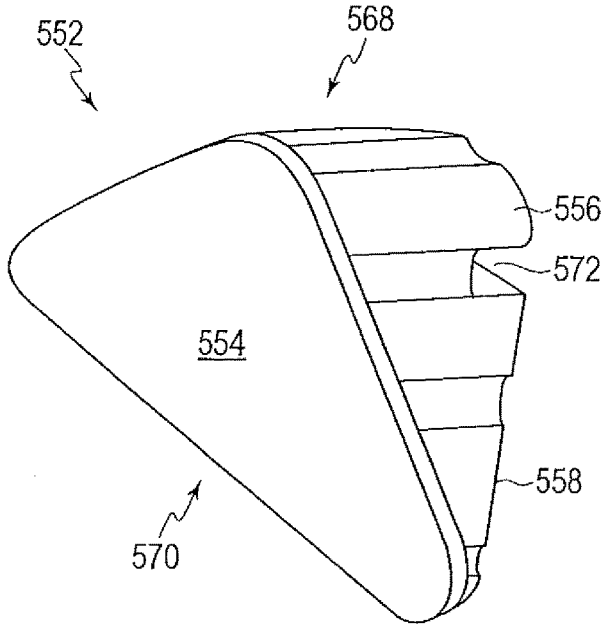
FIG. 5C is a front perspective view of an exemplary insert in accordance with one or more aspects of the present invention.

Referring to FIGS. 5B and 5C, the insert 552 may be bonded to the head 500 by applying, e.g., an epoxy-type adhesive, to the interior walls of the auxiliary recess 550. The insert 552, according to one or more aspects of the present invention, may include one or more ridges 556 to promote the adhesive-bonding strength by increasing the area of the bonding interface. One or more gaps may at least partially separate the ridges to help reduce adhesive "squish-out" when fitting the insert into the auxiliary recess 550 of the club head during assembly. The ridges 556 may be disposed on the insert 552 in any desired orientation. To facilitate the placement of the insert 552 into the recess 550, the insert 552 may also comprise at least one air vent 572, which promotes the expulsion of air from the auxiliary recess 550 as the insert 552 is introduced therein.

Figure 5D:
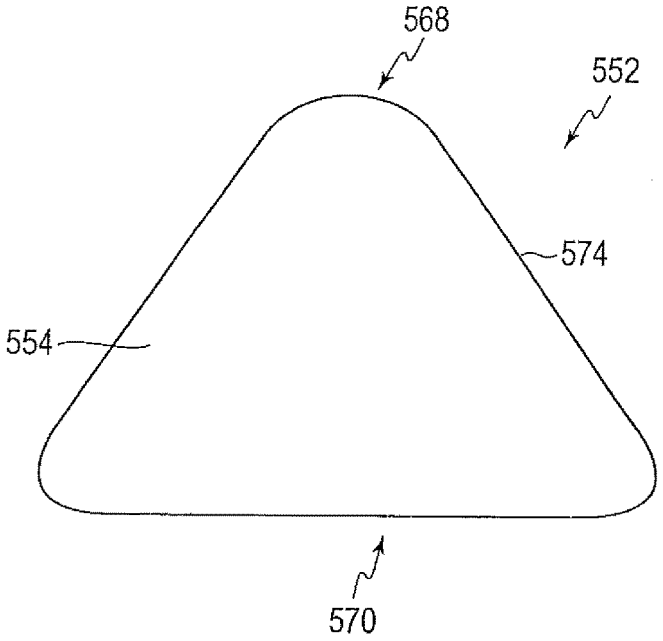
FIG. 5D is a front elevational view of the insert of FIG. 5C.
Figure 5E:
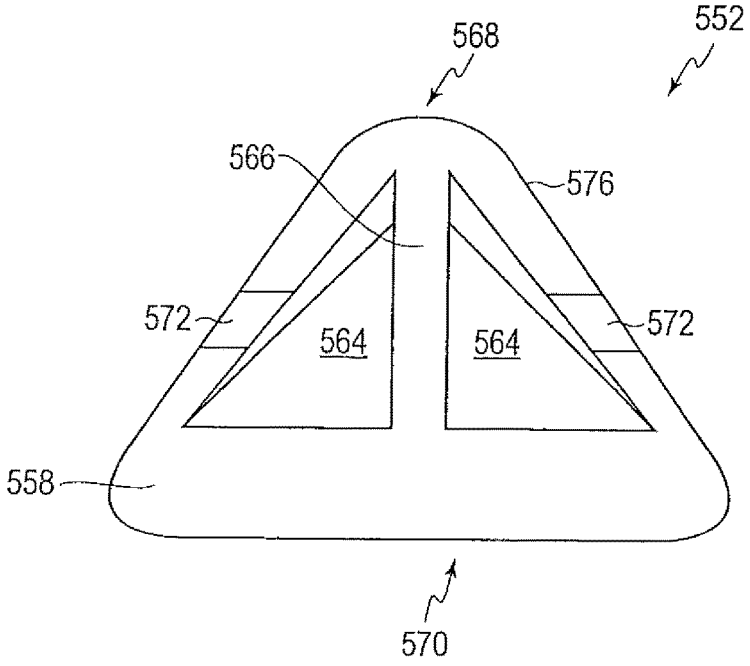
FIG. 5E is a rear elevational view of the insert of FIG. 5C.

As illustrated in FIGS. 5C, 5D, and 5E, the insert 552 includes a posterior side 558 and an anterior side 554. The posterior side 558 may be provided with a cavity 564 to create a discretionary-weight surplus, which may be beneficially redistributed to improve the mass properties and/or the inertial characteristics of the club head.

According to the USGA Rules, all parts of a golf club head must be rigid. To maintain the requisite rigidity of the insert 552, at least one reinforcement member 566 (FIG. 5E) may be incorporated into the cavity 564. One or more reinforcement members 566, according to one or more aspects of the present invention, may be flush with the insert 552, at least in part, recessed, at least in part, and/or salient, at least in part. Regardless of the configuration, the reinforcement member 566 is provided to prevent the insert 552 from deflecting, e.g., more than about 1 mm (0.040 in.) relative to the club head with the application of about 45 N (10 lb) of force. The applied force should generally correspond to the typical force delivered by the thumb of a golfer or a golf official who may wish to test the head for conformance with the applicable rules of golf.

Referring again to FIG. 5E, the reinforcement member 566 may be formed integrally with the remaining portion of the insert 552 resulting in a unitary homogenous component. Conversely, the reinforcement member and the insert body may be made of dissimilar materials. Examples of compositions suitable for fabricating the reinforcement member 566 of the insert may include polymers, such as ABS, Nylon, PVC, Polystyrene, Polypropylene, High Density Polyethylene, glass- or carbon-fiber-reinforced plastic, or the like. Metallic materials, e.g., aluminum, steel, magnesium, titanium, or the like, may also be used. In general, the material selected should provide sufficient stiffness to realize the deflection criteria discussed above. Preferably, the reinforcement member 566 has a Shore hardness less than about 95 A, more preferably less than about 85 A, and most preferably less than about 70 A. In one example, the reinforcement member 566 may be attached to the insert body, e.g., by adhesive bonding or other known methods. Alternatively, the stiffening member 566 may be integrally co-molded with the insert body.

Figure 5F:
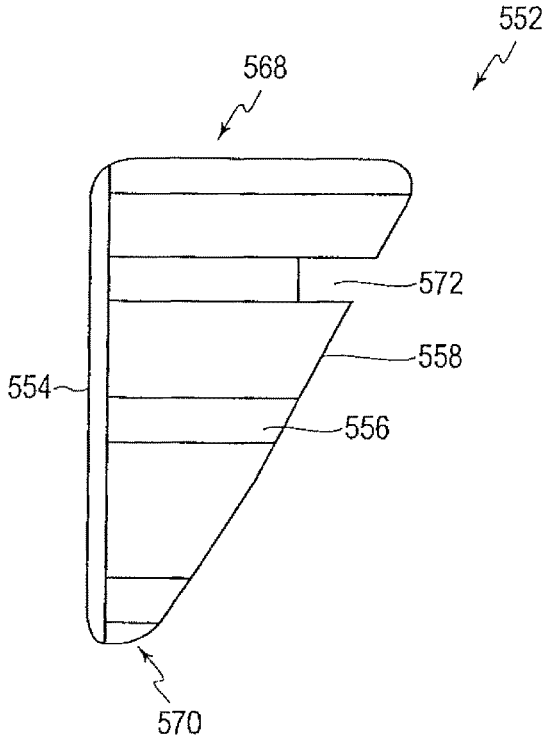
FIG. 5F is a side elevational view of the insert of FIG. 5C.

Referring to FIGS. 5D, 5E, and 5F, the anterior side 554 of the insert 552 may comprise a first substantially planar perimetric boundary 574 having a first length. Moreover, the posterior side 558 of the insert 552 may comprise a second substantially planar perimetric boundary 576 having a second length. Preferably, the ratio of the first length to the second length may be less than 1 and greater than 0.5, more preferably less than 0.95 and greater than 0.5, and most preferably less than 0.9 and greater than 0.5, to maintain the requisite adhesive-bonding area as well as the structural integrity of the strike face.

Referring again to FIGS. 5D and 5E, the anterior side 554 of the insert 552, according to one or more aspects of the present invention, may further comprise, e.g., a triangular front profile, having a base 570 and an apex 568. As shown in FIGS. 5A and 5B, the insert 552 and its retaining cavity, e.g., the auxiliary cavity 550, are oriented so that the apex 568 of the insert is proximal to the sole 508 of the club head and the base 570 of the insert is distal to the sole 508. This orientation of the insert and the triangular silhouette of the anterior side 554 promotes advantageous mass distribution of the club head. Other insert shapes, e.g., a rectangular insert, trapezoidal insert, irregular or any other suitably shaped insert, are also contemplated to be within the scope of the present invention in one or more aspects thereof.

Figure 5G:
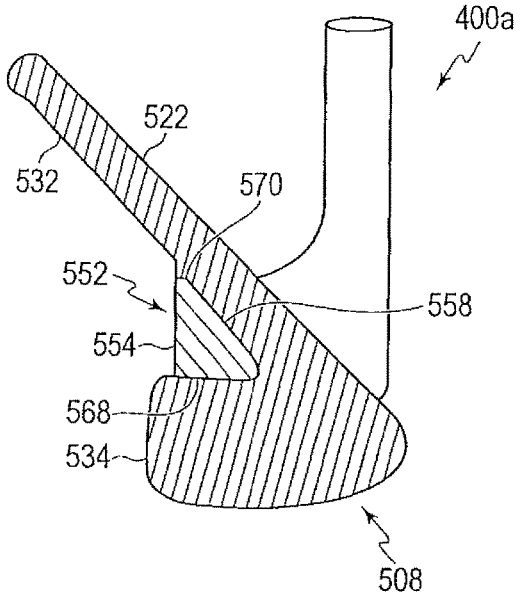
FIG. 5G is a toe-side cross-sectional view of the golf club head of FIG. 5A.

Moreover, the lateral dimension of the insert 552 may decrease from the apex 568 to the base 570, resulting in a triangular side profile. As shown in FIG. 5G, the triangular side profile of the insert increases its adhesive-bonding area and maintains the integrity of the club head's strike face by allowing the thickness of the strike face to remain substantially constant in the region proximate the insert 552.

Referring again to FIG. 3A, an increase in available discretionary mass may also be achieved by providing at least one articulation point, e.g., one or more articulation points 338, along one or more of the plurality of reference paths $P_1 \ldots P_n$ on the muscle portion 334 of the club head. Thus, by utilizing a favorable number of articulation points, a beneficial weight distribution may be achieved. For example, as illustrated in FIG. 3A, a concavity may be formed in the muscle portion 334 of the club head by providing, e.g., at least two articulation points 338. Such a construction allows the mass to be redistributed from a particular portion of the club head to a more favorable location in the head. Accordingly, mass may be redistributed, e.g., to improve the inertial properties of the club head and/or the location of the center of gravity, thus beneficially influencing shot accuracy and distance.

The club head, according to one or more aspects of the present invention, may be formed from a metallic material, e.g., by a forging or casting process. Examples of materials suitable for fabricating the club head may include stainless steel, titanium, or the like. In one example, the club head may be formed, at least in part, of fiber-reinforced or fiberglass-reinforced plastic (FRP), otherwise known as reinforced thermoset plastic (RTP), reinforced thermoset resin (RTR), and glass-reinforced plastic (GRP).

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A golf club head comprising:

a striking face;

a rear portion opposite the striking face, the rear portion having an upper portion and a muscle portion, the upper portion defining a main recess and a perimeter weighting element;

the rear portion further comprising an auxiliary recess entirely disposed within the muscle portion and comprising a generally triangular configuration;

the muscle portion further comprising a concavity; and an elastomeric insert disposed at least partially within the auxiliary recess and having a triangular configuration substantially corresponding to the generally triangular configuration of the auxiliary recess, wherein the elastomeric insert deflects no more than about 1 mm relative to the golf club head upon application of about 45 N of force.

2. The golf club head of claim 1 wherein the elastomeric insert comprises a base and an apex, and the base is oriented in a substantially heel-to-toe direction of the golf club head.

3. The golf club head of claim 2 wherein the base is elongated relative to the apex.

4. The golf club head of claim 1 wherein the elastomeric insert is retained within the auxiliary recess with an adhesive.

5. The golf club head of claim 1 wherein the elastomeric insert comprises a reinforcement member.

6. The golf club head of claim 5 wherein the reinforcement member is positioned substantially at a midpoint of the base.

7. The golf club head of claim 5 wherein the reinforcement member is salient with respect to the elastomeric insert.

8. The golf club head of claim 5 wherein the reinforcement member is integrally formed with the elastomeric insert.

9. The golf club head of claim 1 wherein the concavity is formed, at least in part, by two articulation points in the muscle.

10. The golf club head of claim 1 wherein the elastomeric insert comprises a resilient material selected from the group Polyurethane, silicone, Nylon, polypropylene, polyethylene, thermoplastic rubber, thermoplastic vulcanizate, thermoplastic elastomers, and natural rubber.

11. A golf club head comprising;

a striking face;

a rear portion opposite the striking face, the rear portion having an upper portion and a muscle portion, the upper portion and muscle portion being separated by a transition boundary, the upper portion defining a main recess and a perimeter weighting element;

the rear portion further comprising an auxiliary recess entirely disposed within the muscle portion and comprising a generally triangular configuration; and an elastomeric insert disposed at least partially within the auxiliary recess and having a generally triangular anterior profile substantially corresponding to the generally triangular configuration of the auxiliary recess, the elastomeric insert comprising a base and an apex, the base being oriented in a generally heel-to-toe direction of the golf club head, the elastomeric insert having a durometer hardness of less than about 95 Shore A, wherein the elastomeric insert deflects no more than about 1 mm relative to the golf club head upon application of about 45 N of force.

12. The golf club head of claim 11 wherein the auxiliary recess has a volume of between about 0.5 cm3 and 5.0 cm3.

13. The golf club head of claim 11, the elastomeric insert further comprising an anterior side and a structure extending distally relative to the anterior side, the structure being integrally formed with the elastomeric insert.

14. The golf club head of claim 13 wherein elastomeric insert is bonded to the golf club head with an adhesive, and wherein the structure provides a bonding interface between the elastomeric insert and the golf club head.

15. The golf club head of claim 13 wherein the structure provides reinforcement to the elastomeric insert.

16. The golf club head of claim 11 wherein the elastomeric insert comprises an anterior side perimetric boundary having a first length and a posterior side perimetric body having a second length.

17. The golf club head of claim 16 wherein the first length is different from the second length.

18. The golf club head of claim 16 wherein the first length and second length have a first length:second length ratio of less than 1 and greater than 0.5.

19. The golf club head of claim 11, the golf club head further comprising a concavity formed in the muscle portion by at least two articulation points.

* * * * *